United States Patent [19]

Beavers et al.

[11] Patent Number: 4,912,303

[45] Date of Patent: Mar. 27, 1990

[54] ELECTRIC HEATING BELT FOR LIQUID PROPANE BOTTLES

[76] Inventors: Allan E. Beavers, 638 S. Surrey Ct., Grand Junction, Colo. 81503; Robert A. Fulcher, 3329 N. Ridge Dr., Grand Junction, Colo. 81506

[21] Appl. No.: 312,901

[22] Filed: Feb. 17, 1989

[51] Int. Cl.[4] ..... H05B 1/02; H05B 3/54

[52] U.S. Cl. ..... 219/535; 219/528; 219/536; 219/549; 338/212

[58] Field of Search ..... 219/310–312, 219/528, 535, 529, 548, 549, 527; 338/212, 214

[56] References Cited

U.S. PATENT DOCUMENTS

| | | | |
|---|---|---|---|
| 1,096,916 | 5/1914 | Hoffmann | 219/549 |
| 1,992,593 | 2/1935 | Whitney | 219/535 X |
| 2,215,042 | 9/1940 | Howard et al. | 219/529 |
| 2,710,909 | 6/1955 | Logan et al. | 219/528 X |
| 2,915,615 | 12/1959 | Leipold et al. | 219/528 X |
| 2,985,860 | 5/1961 | Morey | 219/528 X |
| 3,305,668 | 2/1967 | Smith | 219/535 X |
| 3,547,725 | 12/1970 | Shomphe et al. | 219/528 X |
| 3,955,063 | 5/1976 | Berger | 219/527 X |
| 4,101,190 | 7/1978 | Schoff | 219/528 X |
| 4,810,859 | 3/1989 | Anabawi et al. | 219/535 |

FOREIGN PATENT DOCUMENTS

| | | | |
|---|---|---|---|
| 1197277 | 11/1985 | Canada | 219/311 |
| 2810925 | 10/1978 | Fed. Rep. of Germany | 219/311 |
| 2421529 | 11/1979 | France | 219/535 |
| 1599759 | 10/1981 | United Kingdom | 219/311 |

*Primary Examiner*—Anthony Bartis
*Attorney, Agent, or Firm*—Donald W. Erickson

[57] ABSTRACT

An electric heating device for warming liquid propane gas (LPG) bottles includes a flexible heat resistant belt adapted to be secured around the outer peripheral surface of the bottle. The belt has embedded therein an electric resistance heating element with end portions of the belt being heating element-free. A dual safety system is provided on the belt for controlling the heating element and includes a low temperature (60°–80° F.) thermostat secured to a heating element-free end portion of the belt so as to be responsive to the temperature of the bottle and a high temperature (180°–200° F.) thermally-responsive device, such as a thermostat, fuse or circuit breaker located, on the portion of the belt in which the heating element is embedded, for controlling maximum temperature of the belt.

12 Claims, 3 Drawing Sheets

ELECTRIC HEATING BELT FOR LIQUID PROPANE BOTTLES

BACKGROUND OF THE INVENTION

This invention is directed at a safe and reliable bottle warmer for liquid propane (LP) bottles. Propane has properties which make it useful both as a fuel gas and a refrigerant. When ambient temperatures are relatively low as, e.g., in the winter months of the year and the propane is drawn off somewhat rapidly, the refrigerant property of propane can cause freezing. This leads to the formation of frost on te LP bottle which makes it slippery and inconvenient to handle. The freezing also causes inefficient and incomplete use of the propane in that a frozen bottle cannot be recharged fully. Present methods of overcoming the freezing problem of LP are to place the bottle on a hot plate or to apply a torch. Both methods are obviously dangerous because of the explosive nature of LP vapors. Propane gas is heavier than air and odorless which makes the existing heating methods even more dangerous. A principal object of the present invention is to provide a warmer device for liquid propane bottles which overcomes the foregoing problems in a safe and reliable manner.

SUMMARY OF THE INVENTION

The present invention is directed at a bottle warmer for LP bottles which comprises a flexible belt having a heating element embedded therein. The belt is adapted to be wrapped around and conform to the outer surface of the LP bottle. The belt is provided with releasable attachment means for securing it to the bottle. The warmer belt is provided with two thermostats for safety. One thermostat is a high temperature thermostat which controls the temperature of the belt and the other is a low temperature thermostat which senses and controls the temperature of the bottle. The low temperature thermostat is positioned on a heating element-free portion of the belt. The high temperature thermostat is positioned on the part of the belt having a heating element embedded therein. In this way, the bottle warmer has a dual safety system.

DETAILED DESCRIPTION OF THE INVENTION

Figure 1:
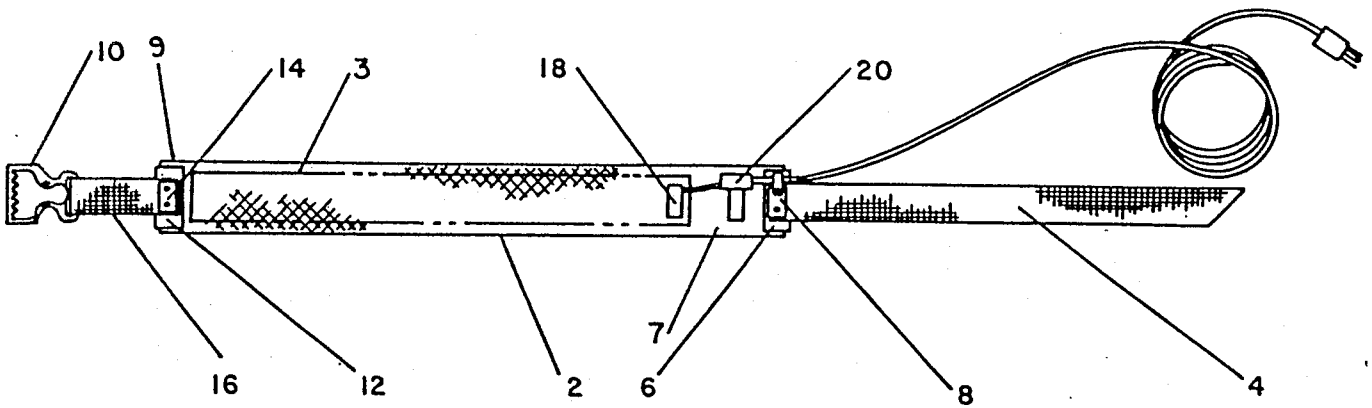
FIG. 1 is a front elevational view of the bottle warmer of the present invention.
Figure 2:
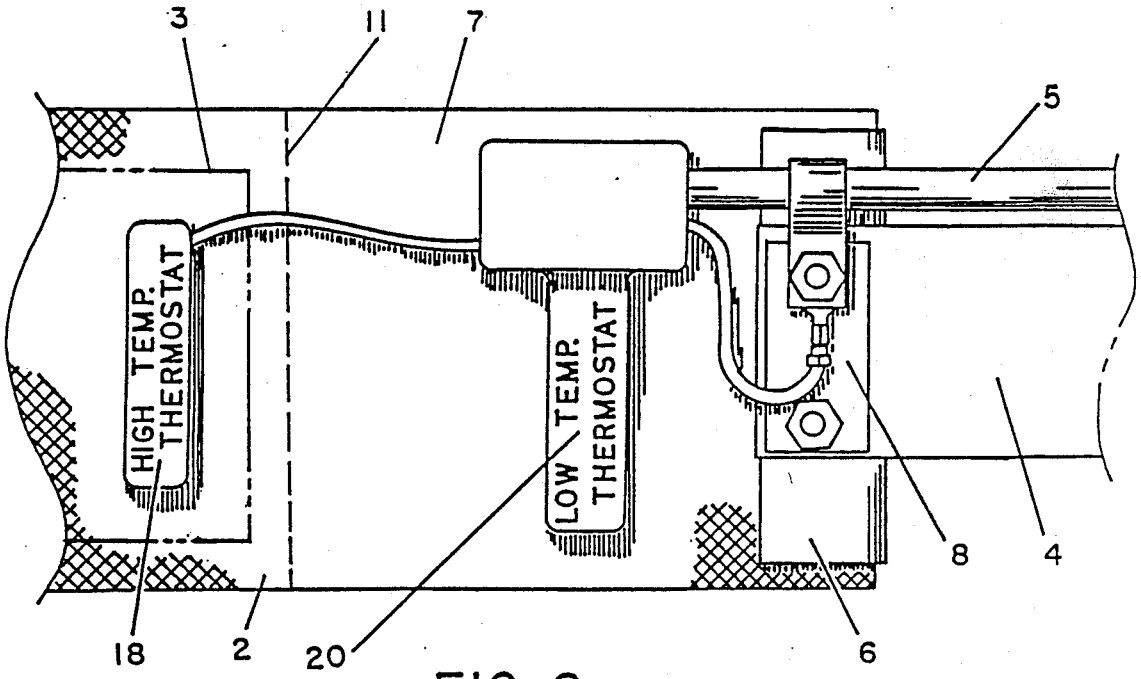
FIG. 2 is a front elevational view, partial section, of the bottle warmer of FIG. 1.
Figure 3:
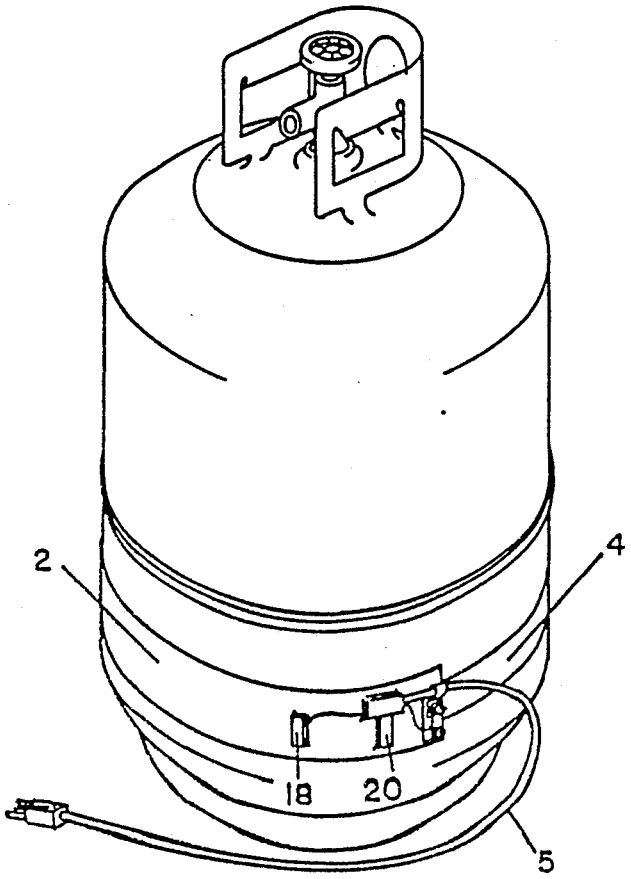
FIG. 3 is a perspective view of the bottle warmer of FIG. 1 in place on an LP bottle.
Figure 4:
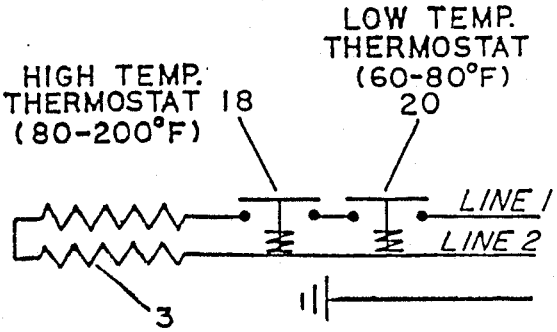
FIG. 4 is a schematic wiring diagram of the electrical circuit of the bottle warmer.
Figure 5:
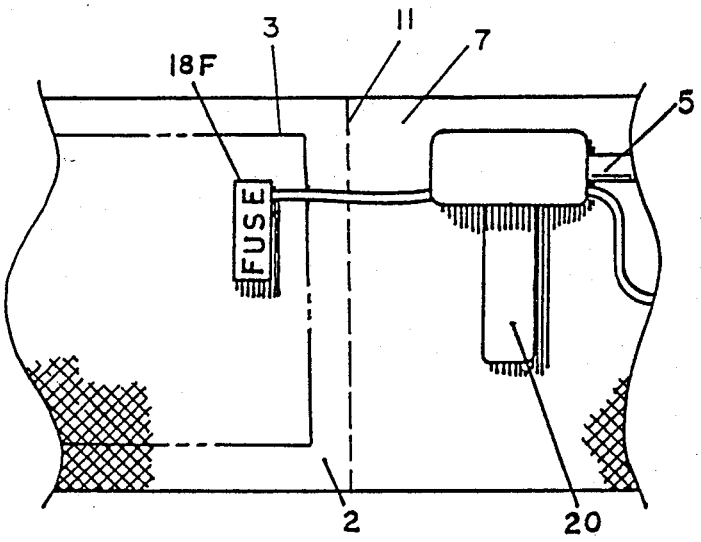
FIG. 5 is a front elevational view, partial section, of another embodiment of the bottle warmer of FIG. 1.
Figure 6:
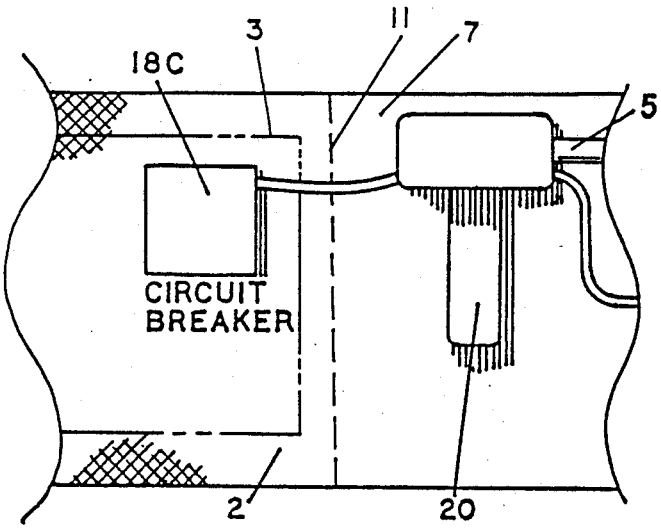
FIG. 6 is a front elevational view, partial section, of another embodiment of the bottle warmer of FIG. 1.

Referring to FIG. 1, there is shown a bottle warmer of the present invention comprising a flexible belt 2 in which there is embedded an electric heating element 3 (shown schematically in FIG. 4) and a power cord 5. The belt is provided with attachment means for securing the flexible heater belt around a LP bottle as shown in FIG. 3. The attachement means in the embodiment shown includes a web belt 4 attached to the heater belt by bolting bolt clip 6 and plate 8 together and pressure buckle 10 which is joined to belt clip 12 and plate 14 by an elastic band 16. A dual safety system is provided by thermostats 18 and 20 which are secured onto belt 2, preferably by vulcanization as shown. Thermostat 18 is a high temperature thermostat positioned on the portion of the belt 2 provided with heating element 3. Thermostate 20 is a low temperature thermostat positioned on the heating element-free end portion 7 of the belt 2 see demarcation line 11. Thermostat 18 responds to and controls the temperature of the belt and thermostat 20 responds to and controls the temperature of the LP bottle. Should one thermostat fail, the other thermostat is in place and ready to break the cycle and prevent overheating of the LP bottle. In the embodiment shown, the flexible belt has an overall dimension of 3 by 25 inches which has proven satisfactory for LP bottles of 20 to 100 lbs. At the buckle end of the belt 2, there is provided a heating element-free end portion 9 of about 1 inch for attaching the belt clip 12. At the other end of belt 2, there is provided a heating element-free and portion 7 of about 3 inches for attachement of belt clip 6 and mounting of the low temperature thermostat 20. The resistance heating element 3 is contained within the boundary of the remaining 21 inches of belt 2. It has been determined that a belt heating element wattage of 375 watts is optimal for operation at about 40° F. ambient temperature and lower. It strikes an excellent balance for maintaining the heat needed to exhaust all of the propane from the bottle and to leave a good tolerance to keep the propane from freezing at about −10° F. and above when the propane is withdrawn at a rate of about 30–50,000 BTU. When the propane is withdrawn at a lower rate such as 10–20,000 BTU, the thermostats will cycle on and off when the ambient temperature is about 40° F. or lower. For the low temperature thermostat 20, it was determined that a temperature of about 60° F. is most optimum to break the heating cycle. This setting will keep the LP bottle pressure below about 150 pounds per square inch (psi), which leaves considerable tolerance. Yet, the LP will be efficiently utilized and prevented from freezing. For the high temperature thermostat 18, a temperature calibration of about 190° F. for the belt 2 is believed to be optimum for ambient temperatures of 40° F. and lower. If the belt heats above about 190° F., the heating cycle is broken. This setting of the high temperature thermostat prevents overheating of the LP bottle at the ambient temperatures mentioned, should the low temperature thermostat fail, and prevents overheating of belt 2 should the belt be accidentally disengaged from the LP bottle. A temperature range of about 60° to 80° F. and about 180° to 200° F. for the low temperature thermostat and high temperature thermostat, respectively, can be used. With ambient temperatures above about 40° F., assuming normal fluctuations of the withdrawal rate of propane, the thermostats will cycle on and off and keep the pressure in the LP bottle about 150 psi.

Suitable thermostats are the Elmwood Company, Pawtucket, RI, precalibrated model B and F. Also, there can be used manual reset thermostats such as Elmwood model 2455RM or equivalent. In place of high temperature thermostat 18, there can be used a fuse 18F or circuit breaker 18C.

The flexible belt 2 is preferably a silicone rubber which may be reinforced with fiberglass or the like. The heating element is embedded within the belt and can be either the wire wound or etched-foil type. Because of its greater strength, the wire woud type of heating element is preferred. Suitable flexible heating belts include the Silicone Rubber and Kapton heating belts of Watlow, St. Louis, MO and the Ramaflex belts of Rama Corp., San Jacinto, CA.

In lieu of the web belt and buckle, other attachment means can be used such as a flexible tension belt that slips over the LP bottle.

The bottle warmer of the present invention operates on a standard 120 V AC line and an amperage of about 3.1.

What is claimed is:

1. An electric bottle warmer for a liquid propane bottle which comprises:

a flexible belt having an electric heating element therein, said belt having a first heating element-free end portion at one end thereof and a second heating element-free end portion at the other end thereof;

a first cycle means consisting of a low temperature thermostat which is secured to a heating element-free end portion of the belt and is responsive to and controls the temperature of the bottle;

a second cycle means selected from a high temperature thermostat, a fuse or a circuit breaker which is secured to the heated portion of the belt in which the heating element is embedded and is responsive to and controls the temperature of the belt; and attachment means for securing the belt to the outer circumference of the bottle.

2. The bottle warmer of claim 1 wherein the belt is made of a heat resistant resin.

3. The bottle warmer of claim 2 wherein the resin is a silicone resin.

4. The bottle warmer of claim 1 wherein the belt is of sufficient length to extend around at least about one-half of the outer circumference of the bottle.

5. The bottle warmer of claim 1 wherein the heating element has a wattage of about 375 watts.

6. The bottle warmer of claim 1 wherein the second cycle means is a thermostat.

7. The bottle warmer of claim 6 wherein the high temperature thermostat cycles off at about 180 to 200 degrees F.

8. The bottle warmer of claim 7 wherein the low temperature thermostat cycles off at about 60 to 80 degrees F.

9. The bottle warmer of claim 8 wherein the heating element has a wattage of about 375 watts.

10. The bottle warmer of claim 1 wherein the low temperature thermostat cycles off at about 60 to 80 degrees F.

11. An electric bottle warmer for a liquid propane bottle which comprises:

a flexible, heat resistant resinous belt having an electric heating element embedded therein, said belt having a first heating element-free end portion at one end thereof and a second heating element-free end portion at the other end thereof;

a first cycle means consisting of a low temperature thermostat which is secured to a heating element-free end portion of the belt and is responsive to and controls the temperature of the bottle, said low temperature thermostat being precalibrated to cycle off at about 60 to 80 degrees F.;

a second cycle means consisting of a high temperature thermostat which is secured to the portion of the belt in which the heating element is embedded and is responsive to and controls the temperature of the belt, said high temperature thermostat being precalibrated to cycle off at about 180 to 200 degrees F.; and attachment means affixed to said heating element-free end portions for securing the belt to the outer circumference of the bottle.

12. The bottle warmer of claim 11 wherein the belt is of sufficient length to extend around at least about one-half of the outer circumference of the bottle.

* * * * *